US008801870B2

(12) United States Patent
Sagawa

(10) Patent No.: US 8,801,870 B2
(45) Date of Patent: Aug. 12, 2014

(54) METHOD FOR MAKING NDFEB SINTERED MAGNET

(75) Inventor: Masato Sagawa, Kyoto (JP)

(73) Assignee: Intermetallics Co., Ltd., Kyoto (JP)

( * ) Notice: Subject to any disclaimer, the term of this patent is extended or adjusted under 35 U.S.C. 154(b) by 409 days.

(21) Appl. No.: 12/595,872

(22) PCT Filed: Apr. 21, 2008

(86) PCT No.: PCT/JP2008/001039

§ 371 (c)(1),
(2), (4) Date: Oct. 14, 2009

(87) PCT Pub. No.: WO2008/139690

PCT Pub. Date: Nov. 20, 2008

(65) Prior Publication Data

US 2010/0119703 A1 May 13, 2010

(30) Foreign Application Priority Data

May 1, 2007 (JP) ..... 2007-121066

(51) Int. Cl.
*H01F 41/00* (2006.01)
*H01F 41/02* (2006.01)

(52) U.S. Cl.
CPC ..... *H01F 41/0293* (2013.01)
USPC ..... 148/101; 427/127

(58) Field of Classification Search
USPC ..... 427/127–132
See application file for complete search history.

(56) References Cited

U.S. PATENT DOCUMENTS

| | | | | |
|---|---|---|---|---|
| 6,080,245 | A * | 6/2000 | Uchida et al. | 148/103 |
| 2003/0079805 | A1* | 5/2003 | Hamada et al. | 148/105 |
| 2007/0017601 | A1 | 1/2007 | Miyata et al. | |
| 2007/0071979 | A1 | 3/2007 | Komuro et al. | |
| 2007/0240789 | A1* | 10/2007 | Nakamura et al. | 148/101 |

FOREIGN PATENT DOCUMENTS

| | | | |
|---|---|---|---|
| BR | PI0506147-4 | A | 10/2006 |
| CN | 1898757 | A | 1/2007 |
| CN | 101006534 | A | 7/2007 |
| CN | 101110289 | A | 1/2008 |
| EP | 0 190 461 | A2 | 8/1986 |
| EP | 1 746 611 | A1 | 1/2007 |
| EP | 1 830 371 | A1 | 9/2007 |
| JP | A-62-74048 | | 4/1987 |
| JP | A-1-117303 | | 5/1989 |
| JP | A-2004-359873 | | 12/2004 |
| JP | A-2005-294558 | | 10/2005 |
| JP | A-2006-303197 | | 11/2006 |
| JP | A-2006-303436 | | 11/2006 |
| JP | A-2007-53351 | | 3/2007 |
| JP | A-2007-287875 | | 11/2007 |
| KR | 10-2007-0012256 | | 1/2007 |
| KR | 10-2007-0068302 | | 6/2007 |
| WO | WO 2006/043348 | A1 | 4/2006 |
| WO | WO 2006/100968 | A1 | 9/2006 |
| WO | WO 2006/112403 | A1 | 10/2006 |
| WO | WO 2008/032426 | A1 | 3/2008 |
| WO | WO 2008/032667 | A1 | 3/2008 |

OTHER PUBLICATIONS

English translation of JP01117303, recieved Mar. 2013, p. 1-11.*
Sep. 1, 2011 Office Action issued in Chinese Patent Application No. 200880008214.6 (with translation).
Ahmed et al.; "Ion Vapour Deposition for Corrosion Protection of Permanent Magnets;" Modem Magnetic Materials. Conference Proceedings, Jun. 20, 1989; pp. 8.3.01-8.3.09.
Extended European Search Report issued in European Application No. 08751583.9 dated Dec. 14, 2012.
Park et al.; "Effect of Metal-Coating and Consecutive Heat Treatment on Coercivity of Thin Nd-Fe-B Sintered Magnets:" *Proceedings of the 16th International Workshop on Rare-Earth Magnets and Their Applications*; 2000; pp. 257-264; vol. 1.
Ishigaki et al.; "Surface Improvements on Magnetic Properties for Small-Sized Nd-Fe-B Sintered Magnets;" *Neomax Technical Report*; 2005; pp. 15-19; vol. 15. (w/ Abstract).
Machida et al.; "Nd-Fe-B Kei Shoketsu Jishaku no Ryukai Kaishitu to Jiki Tokusei;" *Abstracts of Spring Meeting of The Japan Society of Powder and Powder Metallurgy*; 2004; p. 1-47A.
Hirota et al.; "Ryukai Kakusanho ni yoru Nd-Fe-B Kei Shoketsu Jishaku no Kou Hojiryokuka;" *Abstracts of Autumn Meeting of The Japan Society of Powder and Powder Metallurgy*; 2005; p. 143.
Machida et al.; "Ryukai Kaishitu Gata Nd-Fe-B Kei Shoketsu Jishaku no Jiki Tokusei;" *Abstracts of Autumn Meeting of the Japan Society of Powder and Powder Metallurgy*; 2005; p. 144.
Feb. 7, 2012 Office Action issued in Japanese Application No. 2009-513990 (with translation).
Nov. 27, 2012 Japanese Office Action issued in Japanese Patent Application No. 2009-513990 (with translation).
Nov. 11, 2013 Office Action issued in Korean Patent Application No. 10-2009-7018637 (with partial translation).

* cited by examiner

*Primary Examiner* — Mandy Louie
(74) *Attorney, Agent, or Firm* — Oliff PLC

(57) ABSTRACT

The objective of the present invention is to provide a method for making a NdFeB sintered magnet, capable of enhancing the effect of increasing the coercive force and preventing the instability of the effects, and in addition, being inexpensive. The method for making a NdFeB sintered magnet according to the present invention has processes of coating a NdFeB sintered magnet with a powder containing Dy and/or Tb, then heating the NdFeB sintered magnet, and thereby diffusing $R^h$ in the powder into the NdFeB sintered magnet through a grain boundary, and is characterized in that the powder contains 0.5 through 50 weight percent of Al in a metallic state; and the amount of oxygen contained in the NdFeB sintered magnet is equal to or less than 0.4 weight percent.

9 Claims, No Drawings

METHOD FOR MAKING NDFEB SINTERED MAGNET

TECHNICAL FIELD

The present invention relates to a method for making a rare-earth magnet. In particular, it relates to a method for making a NdFeB sintered magnet having a high coercive force.

BACKGROUND ART

The demand for NdFeB sintered magnets is anticipated to rise more and more in the future as a magnet for a motor of hybrid cars or other applications. Since there is a demand for a lighter automotive motor, further increase in the coercive force $H_{cJ}$ is needed. One of the known methods for increasing the coercive force $H_{cJ}$ of a NdFeB sintered magnet is substituting Dy or Tb for a portion of Nd. However, this method has disadvantages in that the resources of Dy and Tb are globally poor and unevenly distributed, and the residual flux density $B_r$ and the maximum energy product $(BH)_{max}$ are decreased.

Patent Document 1 discloses, in order to keep the coercive force from decreasing in machining the surface of a NdFeB sintered magnet for fabricating a thin film or other purposes, a technique of coating at least one kind from among Nd, Pr, Dy, Ho, and Tb on the surface of the NdFeB sintered magnet. Patent Document 2 discloses a technique of diffusing at least one kind among Tb, Dy, Al, and Ga on the surface of a NdFeB sintered magnet in order to restrain the irreversible demagnetization which occurs at high temperatures.

Recently, it has been discovered that the coercive force $H_{cJ}$ of a magnet can be increased with little decrease in the residual flux density $B_r$ by using a method called a grain boundary diffusion method (Non-Patent Documents 1 through 3). The principle of the grain boundary diffusion process is as follows.

After depositing Dy and/or Tb on the surface of a NdFeB sintered magnet by sputtering, the NdFeB sintered magnet is heated at 700 through 1000° C. Then, the Dy and/or Tb on the surface of the magnet diffuse into the sintered compact through the grain boundaries of the sintered compact. At the boundaries inside the NdFeB sintered magnet, a grain boundary phase called a Nd rich phase which is rich in rare earths is present. This Nd rich phase has a lower melting point than that of magnet grains and melts at the aforementioned heating temperature. As a result, the Dy and/or Tb dissolve in the liquid of the grain boundaries and diffuse from the surface of the sintered compact into the inside thereof. Since substances diffuse much faster in liquids than in solids, the Dy and/or Tb diffuse inside the sintered compact through melted grain boundaries much faster than they diffuse into grains from the grain boundaries. By utilizing this difference in the diffusion rate, the heat treatment temperature and the time can be set to be an appropriate value to realize the state in which Dy and/or Tb are dense only in the area (surface area) very close to the grain boundaries of the main phase grain inside a sintered compact throughout the entire sintered compact. Although the residual flux density $B_r$ of a magnet decreases with the increase in the density of Dy and/or Tb, such decrease occurs only on the surface area of each main phase grain, and the residual flux density $B_r$ of an entire main phase grain decreases little. In such a manner, it is possible to manufacture a high-performance magnet with high coercive force $H_{cJ}$ and residual flux density $B_r$ comparable to those of a NdFeB sintered magnet in which no substitution with Dy or Tb has been made.

Industrial manufacturing methods of a NdFeB magnet by the grain boundary diffusion process have been already disclosed such as: forming a fluoride or oxide fine powder layer of Dy or Tb on the surface of a NdFeB sintered magnet and then heating it (Patent Document 3); or burying a NdFeB sintered magnet in the mixed powder of a powder of the fluoride of Dy or Tb and a powder of calcium hydride, and heating it (Non-Patent Documents 4 and 5).

[Patent Document 1] Japanese Unexamined Patent Application Publication No. S62-074048

[Patent Document 2] Japanese Unexamined Patent Application Publication No. H01-117303

[Patent Document 3] International Publication Pamphlet No. WO2006/043348

[Non-Patent Document 1] K. T. Park et al., "Effect of Metal-Coating and Consecutive Heat Treatment on Coercivity of Thin Nd—Fe—B Sintered Magnets," *Proceedings of the Sixteenth International Workshop on Rare-Earth Magnets and Their Applications* (2000), pp. 257-264.

[Non-Patent Document 2] N. Ishigaki et al., "Surface Improvements on Magnetic Properties for Small-Sized Nd—Fe—B Sintered Magnets," *Neomax Technical Report* vol. 15, pp. 15-19, 2005.

[Non-Patent Document 3] K. Machida et al. "Nd—Fe—B Kei Shoketsu Jishaku no Ryukai Kaishitu to Jiki Tokusei," *Abstracts of Heisei* 16 *nen* (=2004) *Spring Meeting of The Japan Society of Powder and Powder Metallurgy*, The Japan Society of Powder and Powder Metallurgy, 1-47A.

[Non-Patent Document 4] K. Hirota et al. "Ryukai Kakusanho ni yoru Nd—Fe—B Kei Shoketsu Jishaku no Kou Hojiryokuka," *Abstracts of Heisei* 17 *nen* (=2005) *Spring Meeting of The Japan Society of Powder and Powder Metallurgy*, The Japan Society of Powder and Powder Metallurgy, p. 143.

[Non-Patent Document 5] K. Machida et al. "Ryukai Kaishitu Gata Nd—Fe—B Kei Shoketsu Jishaku no Jiki Tokusei," *Abstracts of Heisei* 17 *nen* (=2005) *Spring Meeting of The Japan Society of Powder and Powder Metallurgy*, The Japan Society of Powder and Powder Metallurgy, p. 144.

DISCLOSURE OF THE INVENTION

Problem to be Solved by the Invention

The aforementioned conventional techniques have the following disadvantages:

(1) the methods described in Patent Documents 1 and 2 are not so effective in increasing the coercive force;

(2) the methods (of Non-Patent Documents 1 through 3) in which components containing Dy or Tb are deposited on the surface of a magnet by the sputtering method or the ion plating method are impractical due to the high processing cost; and (3) the method (of Patent Document 3) in which the powder of $DyF_3$ and $Dy_2O_3$ or $TbF_3$ and $Tb_2O_3$ are coated on the surface of a magnet base material compact has disadvantages in that the increase in the coercive force is not so large and the effects are instable, in spite of the advantage of the low processing cost.

The problem to be solved by the present invention is to provide a method for making a NdFeB sintered magnet, capable of enhancing the effect of increasing the coercive force and preventing the instability of the effects, and in addition, being inexpensive.

Means for Solving the Problem

To solve the previously-described problem, the present invention provides a method for making a NdFeB sintered magnet including the processes of coating a NdFeB sintered magnet with a powder containing $R^h$ (where $R^h$ represents Dy and/or Tb), then heating the NdFeB sintered magnet, and thereby diffusing $R^h$ in the powder into the NdFeB sintered magnet through the grain boundaries, wherein:

the powder contains 0.5 through 50 weight percent of Al in a metallic state; and the amount of oxygen contained in the NdFeB sintered magnet is equal to or less than 0.4 weight percent.

The amount of oxygen is preferably equal to or less than 0.3 weight percent.

The powder may contain a fluoride of $R^h$. Alternatively, the powder may contain a powder of an alloy of $RR^hT$ (where R represents one or plural kinds from among rare earth elements other than Dy and Tb, and T represents one or plural kinds from among Fe, Co, and Ni) and/or an alloy of $RR^hTB$.

Effects of the Invention

With the present invention, the coercive force $H_{cJ}$ can be increased and the instability of the effects can be reduced, while preventing the deterioration of the residual flux density $B_r$, maximum energy product $(BH)_{max}$ or the squareness quality of the magnetization curve. In addition, since in the present invention relatively inexpensive element of Al is used and the amount of expensive Dy or Tb is minimized, the production costs can be suppressed.

BEST MODE FOR CARRYING OUT THE INVENTION

A NdFeB sintered magnet which serves as the base material in the present invention basically has the composition of, in weight ratio, approximately 30% of Nd, approximately 1% of B, and the balance Fe. A portion of Nd may be substituted by Pr or Dy, and a portion of Fe may be substituted by Co. Further, to this base material, Al or Cu may be added as minor additive elements. Moreover, a small amount of heat-resistant metal element such as Nb or Zr may be added to this base material in order to prevent the abnormal grain growth during the sintering process.

The base material is prepared in the following manner.

First, a bulk of the alloy of the NdFeB magnet having the aforementioned composition is made using a strip cast method. Next, the bulk is crushed by a jet mill in an inactive gas to make a fine powder of the NdFeB magnet alloy. Then, the fine powder is pressed in an inactive gas while applying a magnetic field to make a compact in which the powder is oriented. After that, the compact is sintered in vacuum or in an inactive gas atmosphere to obtain a sintered compact of the NdFeB magnet.

Conventionally, in general, fine powder is pressed in air. In the present invention, since the amount of oxygen in the base material's sintered compact is required to be equal to or less than 0.4 weight percent, preferably equal to or less than 0.3 weight percent, the fine powder is always treated in an inactive gas or in vacuum as previously described.

After shaping the base material to the compact of near final product, a powder containing $R^h$ and Al (which will hereinafter be referred to as "$R^h$—Al powder") is coated on the surface of the base material compact. As a method for coating the $R^h$—Al powder, the spraying method or the method using a liquid of suspension described in Non-Patent Document 4 can be used. In the latter method, powder is suspended in a solvent such as alcohol, the magnet is dipped into the suspension liquid, and the magnet is raised and dried with the suspension powder attached on the surface of the magnet. Alternatively, the coating of the $R^h$—Al powder can be performed by the barrel painting method (refer to Japanese Unexamined Patent Application Publication No. 2004-359873) which will be described later. In the barrel painting method, the $R^h$—Al powder containing precious rare earth elements is wasted little and a powder layer with a uniform thickness can be formed. Therefore, this method is more preferable than the spraying method and the method using a suspension.

The method for coating the surface of the base material compact with an $R^h$—Al powder by using the barrel painting method is now described. First, the surface of the base material compact to be treated is coated with an adhesive substance, such as liquid paraffin, to form an adhesive layer. Then, the $R^h$—Al powder and metallic or ceramic microspheres (which is referred to as "impact media") are mixed, the base material compact is put into the mixture, and they are vibrated and agitated. This follows that the $R^h$—Al powder is brought onto the adhesive layers with the impact media, where the $R^h$—Al powder is attached and coated on the surface of the base material compact.

Next, an explanation for the $R^h$—Al powder will be made.

As $R^h$, it is practically preferable to use Dy whose abundance as a resource is far larger than that of Tb. Therefore, although the following explanation is made on the example of Dy, it is also applicable to Tb.

As the powder containing Dy, a powder of a compound such as $DyF_3$ or $Dy_2O_3$, or a powder of an alloy, or an intermetallic compound, of Dy and transition metals (T) can be used. The element Al can be contained in the Dy-containing powder in the following manners for instance: the first example is a mixture of the powder containing Dy and the powder of Al in a metallic state; the second example is the powder obtained by crushing the alloyed material of a compound or alloy containing Dy with Al in a metallic state. The second example includes the powder of the alloy of NdDyTAl and NdDyTBAl which are the alloy of NdDyT and NdDyTB, and Al; and the third example is the powder obtained by mixing the powder of $DyF_3$ and the powder of Al well, heating the mixture to a high temperature (up to 800° C.) to obtain a mass of inter-melted or solid mixture of $DyF_3$ and Al, and then crushing the mass.

An $R^h$—Al powder may absorb hydrogen during the production process, and such a hydrogen-containing powder can be used in the present invention.

The adding amount or content of Al is required at least 0.5%, and preferably equal to or more than 1%. In the case where the amount of Al is less than 0.5%, the effect of Al, i.e. the coercive force increasing effect can be hardly obtained in practice. The maximum value of the amount of Al is approximately 50%. In the case where the amount of Al is larger than this, the coercive force $H_{cJ}$ of the sintered compact after a grain boundary diffusion process becomes smaller than the case where Al is not added.

The alloy of RDyT and RDyTB used in the aforementioned second example is explained.

(1) Nd or Pr is preferable for R, and Fe, Co, or Ni is preferable for T.

(2) The sum of R and Dy preferably accounts for 20 through 60 weight percent of the entire alloy.

(3) The ratio of Dy to R in the aforementioned Dy-containing powder is required to be higher than the ratio of Dy to R in the base material.

(4) As R and T, in addition to those given in (1), a small amount of other rare earth elements (such as Ce or La) and other transition metal elements can be added.

The average grain diameter (median-in-mass grain diameter) of the Dy-containing powder is preferably equal to or less than 30 μm. Too large grain diameter causes a problem in that the coating by spray method or barrel painting method is difficult to perform. From the viewpoint of increasing the coercive force by the grain boundary diffusion process, the average grain diameter is preferably equal to or less than 10 μm, and more preferably, equal to or less than 3 μm. In the case where the grain diameter is equal to or less than 2.5 μm, more preferably equal to or less than 2 μm, an additional advantage can be obtained in that the surface layer formed on the magnet surface after the grain boundary diffusion process becomes smooth, dense, and also the adhesiveness is improved.

The forming of the surface layer using a powder with small grain diameter as just described allows the magnet to be put into practice with the surface layer remaining formed, which alleviates the processing cost of the magnet. In addition, if a large amount of Ni and Co is previously contained in the powder containing Dy, the surface layer after the grain boundary diffusion process functions as a corrosion-inhibiting coating, which can alleviate the coating cost and pre-treatment cost such as pickling before coating.

The thickness of the powder layer containing Dy is preferably equal to or less than 150 μm, and more preferably, equal to or less than 75 μm. In addition, by performing a simple preliminary experiment, the thickness of the powder layer before the grain boundary diffusion process may be preferably determined so that the thickness of the surface layer after the process becomes equal to or more than 2 μm and equal to or less than 10 μm. More preferably, the thickness of the surface layer after the grain boundary diffusion process may be equal to or more than 5 μm and equal to or less than 40 μm. Too thick surface layer wastes a powder containing costly Dy, and too thin surface layer leads to an insufficient coercive force increasing effect of the grain boundary diffusion process.

In the present invention, the amount of oxygen in a base material significantly influences the coercive force increasing effect of the grain boundary diffusion process. Although the amount of oxygen in a base material is in many cases equal to or more than 0.4 weight percent for commercially available NdFeB sintered magnets, it is required to be equal to or less than 0.4 weight percent in the present invention. This amount of oxygen is preferably equal to or less than 0.3 weight percent, and more preferably equal to or less than 0.2 weight percent. The lower the oxygen content in base material is, the larger the coercive force increasing effect becomes.

The heating temperature in the grain boundary diffusion process is preferably 700 through 1000° C. As a typical example, the heating temperature and time may respectively be 800° C. and 10 h, or 900° C. and 1 h. In addition, a heat treatment including a rapid cooling can be performed after the grain boundary diffusion process. For example, either one of the following processes can be performed: (i) rapid cooling (quenching) from the grain boundary diffusion process temperature to room temperature, then heating to around 500° C., and finally quenching again to the room temperature; and (ii) slowly cooling from the grain boundary diffusion process temperature to around 600° C., quenching to the room temperature, then heating to 500° C., and finally quenching again to the room temperature. Such a quenching process can improve the grain boundary's fine structure, which further enhances the coercive force.

Embodiment

A NdFeB sintered magnet which served as a base material compact was manufactured by the following method: first, a bulk of strip cast alloy was reduced to a fine powder by a hydrogen crushing and jet mill, then the fine powder was pressed into a compact in a magnetic field, and the compact was heated to be sintered. To make a hypoxic NdFeB sintered compact which is required for the present invention, in the aforementioned jet mill process, a high-purity $N_2$ gas at purity level of 99.999% and above was used as a milling gas. The fine powder was always treated in a high-purity Ar gas from the milling process through the compact forming process, and the compact was sintered in the vacuum of $10^{-4}$ Pa. Due to oxygen slightly contained in the $N_2$ gas and Ar gas, the sintered compact after sintering also slightly contains oxygen. In the present embodiment, three kinds of NdFeB sintered magnet base material compacts (base material numbers: A-1, A-2, and A-3) with the oxygen contents of 0.14, 0.25, and 0.34 weight percent were obtained by this method. Likewise, for a Dy-added NdFeB sintered magnet, two kinds of base material compacts (B-1 and B-2) with the oxygen contents of 0.15 and 0.29 weight percent were made.

As a comparative example, by using a gas in which 0.1% of oxygen was mixed to the $N_2$ gas in a milling process by a jet mill, a NdFeB sintered magnet base material compact (A-4) containing 0.45% of oxygen by weight (i.e. no Dy was added) was made.

The powder of the NdFeB sintered magnet of the comparative example is stable in the air and not ignited due to a slight oxidation of its surface. Hence, such stabilized powder has been conventionally used for manufacturing NdFeB sintered magnets. Many of such conventional NdFeB sintered magnets contain oxygen of 4000 ppm or above or 5000 ppm or above.

The average grain diameter of the fine powder after the jet mill process was approximately 5 μm for every sample by the value of median-in-mass grain diameter measured by a laser particle size distribution analyzer of Sympatec Inc.

The chemical analysis values of the obtained base material compact of NdFeB sintered magnet are shown in Table 1.

TABLE 1

COMPOSITIONS OF NdFeB SINTERED MAGNET BASE MATERIAL COMPACTS (weight percent)

| BASE MATERIAL NUMBER | Nd | Pr | Dy | Fe | Co | B | Al | Cu | C | O | REMARKS |
|---|---|---|---|---|---|---|---|---|---|---|---|
| A-1 | 26.8 | 4.7 | — | Balance | 0.9 | 1 | 0.25 | 0.1 | 0.08 | 0.14 | |
| A-2 | 26.7 | 4.8 | — | Balance | 0.9 | 1 | 0.25 | 0.1 | 0.07 | 0.25 | |
| A-3 | 26.6 | 4.9 | — | Balance | 0.9 | 1 | 0.25 | 0.1 | 0.08 | 0.34 | |
| A-4 | 26 | 4 | — | Balance | 0.9 | 1 | 0.25 | 0.1 | 0.08 | 0.45 | Comparative Example |

TABLE 1-continued

COMPOSITIONS OF NdFeB SINTERED MAGNET BASE MATERIAL COMPACTS (weight percent)

| BASE MATERIAL NUMBER | Nd | Pr | Dy | Fe | Co | B | Al | Cu | C | O | REMARKS |
|---|---|---|---|---|---|---|---|---|---|---|---|
| B-1 | 25 | 2 | 4 | Balance | 0.9 | 1 | 0.25 | 0.1 | 0.08 | 0.15 | |
| B-2 | 28 | 2 | 1 | Balance | 0.9 | 1 | 0.25 | 0.1 | 0.08 | 0.29 | |

From these NdFeB sintered magnet base material compacts, rectangular parallelepipeds of 7 mm in length by 7 mm in width by 4 mm in thickness were cut out. The thickness direction was adjusted to coincide with the direction of the magnetic orientation.

Next, powders for applying on the FdFeB sintered magnet base material compacts in the grain boundary diffusion process were manufactured. The compounding ratios of the powders' material are listed in Table 2.

TABLE 2

COMPOUNDING RATIOS OF THE POWDERS TO BE APPLIED ON THE SURFACE OF THE BASE MATERIAL COMPACTS

| POWDER NUMBER | COMPOUNDING RATIO |
|---|---|
| P-1 | 90% $Dy_2O_3$, 10% Al |
| P-2 | 99% $DyF_3$, 1% Al |
| P-3 | 97% $DyF_3$, 3% Al |
| P-4 | 90% $DyF_3$, 10% Al |
| P-5 | 70% $DyF_3$, 30% Al |
| P-6 | 50% $DyF_3$, 50% Al |
| P-7 | 80% $DyF_3$, 10% $Dy_2O_3$, 10% Al |
| P-8 | 90% M-1 (grain diameter 3 μm), 10% Al |
| P-9 | 100% M-2 (grain diameter 3 μm) |
| P-10 | 100% M-3 (grain diameter 3 μm) |
| P-11 | 100% M-4 (grain diameter 3 μm) |
| P-12 | 100% M-5 (grain diameter 3 μm) |
| P-13 | 100% M-6 (grain diameter 3 μm) |
| P-14 | 100% M-2 (grain diameter 2 μm) |
| P-15 | 100% M-4 (grain diameter 2 μm) |
| P-16 | 70% M-2 (grain diameter 3 μm), 30% $DyF_3$ |
| P-4m | 90% $DyF_3$, 10% Al<br>Heated, melted and then crushed |

Among these powders, those of the powder numbers P-1 through P-7 were prepared by mixing $Dy_2O_3$ powder (P-1) having an average grain diameter of approximately 1 μm, $DyF_3$ powder (P-2 through P-6) having an average grain diameter of approximately 5 μm, or both of these powders (P-7), with Al powder having an average grain diameter of approximately 3 μm, in an Ar gas by an agitating blade mixer. In addition, the powder P-4 were heated to 750° C. in vacuum to be melted, then it was solidified and crushed by a ball mill to obtain a powder (P-4m).

The powders of the powder numbers P-8 through P-16 were the powder of alloys M-1 through M-6 containing Dy or Tb and Al as their component, and a mixture of the alloy powder and the powder of Al or $DyF_3$. Among these powders, an alloy powder having a diameter of 3 μm was used for the powders P-8 through P-13 and P-16, and an alloy powder having a diameter of 2 μm was used for the powders P-14 and P-15. The powder P-8 was a mixture of the alloy powder of M-1 and a 10 weight percent Al powder, and the powder P-16 was a mixture of the alloy powder of M-2 and a 30 weight percent $DyF_3$ powder. Table 3 shows the compositions of the alloys M-1 through M-6.

TABLE 3

COMPOSITIONS OF ALLOY POWDERS M-1 THROUGH M-6 (weight percent)

| ALLOY NUMBER | Dy | Tb | Nd | Pr | Fe | Co | Ni | Al | Cu | B |
|---|---|---|---|---|---|---|---|---|---|---|
| M-1 | 19 | — | 14 | — | Balance | 19.7 | — | 0.2 | 0.14 | 1 |
| M-2 | 23 | — | 10 | — | Balance | 11.2 | 16.8 | 10 | — | 1 |
| M-3 | 23 | — | 10 | — | Balance | 5 | 16.8 | 10 | — | 1 |
| M-4 | 28 | — | 5 | — | Balance | — | — | 10 | — | 1 |
| M-5 | — | 25 | 10 | — | Balance | 12.6 | 18.9 | 5 | — | 1 |
| M-6 | 15 | — | 20 | — | Balance | — | — | 10 | 0.1 | — |

As comparative examples of the powders for applying a NdFeB sintered magnet base material compact, those shown in the following Table 4 were prepared.

TABLE 4

COMPOUNDING RATIOS OF THE POWDERS TO BE APPLIED ON THE SURFACE OF THE BASE MATERIAL COMPACTS (COMPARATIVE EXAMPLES)

| POWDER NUMBER | COMPOUNDING RATIO |
|---|---|
| Q-1 | 100% $Dy_2O_3$ |
| Q-2 | 100% $DyF_3$ |
| Q-3 | 80% $DyF_3$, 20% $Dy_2O_3$ |
| Q-4 | 100% M-1 (grain diameter 3 μm) |
| Q-5 | 30% $DyF_3$, 70% Al |

Among those, the powders Q-1 through Q-3 were composed of solely a $Dy_2O_3$ powder, $DyF_3$ powder, or the mixture powder of both powders, and they did not contain an Al powder. The powder Q-4 was composed of the alloy M-1 which contains Al of only 0.3 weight percent. The powder Q-5 was a mixture of a 70 weight percent Al powder and a 30 weight percent $DyF_3$ powder.

Next, a grain boundary diffusion process was performed by applying the aforementioned powders P-1 through P-16, and P-4m by a barrel painting method on the surface of the aforementioned NdFeB sintered magnet base material compacts A-1 through A-3, B-1, and B-2 (except A-4 which is a comparative example) and heating them at a predetermined temperature and for a predetermined time. For the obtained samples S-1 through S-31, the base materials and powders used, the heating temperatures and heating times, and their magnetic properties are shown in Table 5. For the samples C-1 through C-6 which were prepared by using the powders Q-1 through Q-5 of comparative examples, and for the samples C-7 through C-18 prepared by using the base material compact A-4 of a comparative example, the base materials and powders used, the heating temperatures and heating times, and their magnetic properties are shown in Table 6. In addition, the magnetic properties of the base material compacts are shown in Table 7. "SQ" shown in these tables is a value representing the squareness quality of the magnetization curve.

TABLE 5

MAGNETIC PROPERTIES OF THE NdFeB SINTERED MAGNETS MADE IN THE PRESENT EMBODIMENT

| | BASE | | GRAIN BOUNDARY DIFFUSION CONDITIONS | | MAGNETIC PROPERTIES | | | |
|---|---|---|---|---|---|---|---|---|
| SAMPLE NUMBER | MATERIAL NUMBER | POWDER NUMBER | TEMPERATURE (° C.) | TIME (h) | Br (kG) | $H_{cJ}$ (kOe) | $(BH)_{max}$ (MGOe) | SQ (%) |
| S-1 | A-1 | P-1 | 800 | 10 | 14.1 | 16.8 | 48.3 | 86.6 |
| S-2 | A-1 | P-2 | 800 | 10 | 13.8 | 18.4 | 46.4 | 88.2 |
| S-3 | A-1 | P-3 | 800 | 10 | 13.7 | 19.9 | 46.0 | 89.1 |
| S-4 | A-1 | P-4 | 800 | 10 | 13.8 | 20.4 | 46.1 | 92.2 |
| S-5 | A-1 | P-5 | 800 | 10 | 13.8 | 19.6 | 46.2 | 90.1 |
| S-6 | A-1 | P-6 | 800 | 10 | 13.5 | 18.2 | 44.4 | 86.2 |
| S-7 | A-1 | P-7 | 800 | 10 | 13.7 | 19.5 | 45.5 | 88.9 |
| S-8 | A-1 | P-8 | 900 | 1 | 13.7 | 20.0 | 45.7 | 89.2 |
| S-9 | A-1 | P-9 | 900 | 1 | 13.8 | 20.6 | 46.1 | 89.1 |
| S-10 | A-1 | P-10 | 900 | 1 | 13.7 | 21.3 | 45.7 | 88.8 |
| S-11 | A-1 | P-11 | 900 | 1 | 13.7 | 20.9 | 45.9 | 90.8 |
| S-12 | A-1 | P-12 | 900 | 1 | 13.7 | 22.7 | 45.7 | 89.6 |
| S-13 | A-1 | P-13 | 900 | 1 | 13.9 | 19.0 | 46.8 | 84.5 |
| S-14 | A-1 | P-14 | 900 | 1 | 13.7 | 20.5 | 45.9 | 88.8 |
| S-15 | A-1 | P-15 | 900 | 1 | 13.7 | 21.0 | 45.4 | 88.6 |
| S-16 | A-1 | P-16 | 900 | 1 | 13.8 | 21.2 | 46.3 | 89.2 |
| S-17 | A-1 | P-4m | 800 | 10 | 13.7 | 21.1 | 45.5 | 89.0 |
| S-18 | A-2 | P-4m | 800 | 10 | 13.7 | 19.9 | 45.3 | 85.2 |
| S-19 | A-2 | P-9 | 900 | 1 | 13.9 | 19.3 | 46.0 | 86.1 |
| S-20 | A-2 | P-10 | 900 | 1 | 13.6 | 19.3 | 45.0 | 85.2 |
| S-21 | A-2 | P-11 | 900 | 1 | 13.7 | 19.4 | 45.3 | 85.9 |
| S-22 | A-3 | P-6 | 900 | 1 | 13.9 | 18.1 | 47.9 | 82.5 |
| S-23 | A-3 | P-4m | 800 | 10 | 13.8 | 18.3 | 45.8 | 81.9 |
| S-24 | B-1 | P-4 | 800 | 10 | 13.0 | 25.5 | 41.2 | 89.2 |
| S-25 | B-1 | P-9 | 900 | 1 | 13.0 | 26.9 | 41.5 | 90.6 |
| S-26 | B-1 | P-10 | 900 | 1 | 13.1 | 24.9 | 41.7 | 91.0 |
| S-27 | B-1 | P-11 | 900 | 1 | 13.1 | 25.3 | 41.9 | 91.6 |
| S-28 | B-1 | P-4m | 800 | 10 | 13.1 | 25.9 | 41.5 | 90.9 |
| S-29 | B-2 | P-9 | 900 | 1 | 13.9 | 20.7 | 47.6 | 84.2 |
| S-30 | B-2 | P-10 | 900 | 1 | 14.0 | 20.7 | 47.7 | 85.9 |
| S-31 | B-2 | P-11 | 900 | 1 | 13.9 | 20.7 | 47.6 | 84.1 |

TABLE 6

MAGNETIC PROPERTIES OF THE NdFeB SINTERED MAGNETS AS COMPERATIVE EXAMPLES

| | BASE | | GRAIN BOUNDARY DIFFUSION CONDITIONS | | MAGNETIC PROPERTIES | | | |
|---|---|---|---|---|---|---|---|---|
| SAMPLE NUMBER | MATERIAL NUMBER | POWDER NUMBER | TEMPERATURE (° C.) | TIME (h) | Br (kG) | $H_{cJ}$ (kOe) | $(BH)_{max}$ (MGOe) | SQ (%) |
| C-1 | A-1 | Q-1 | 800 | 10 | 13.5 | 15.9 | 44.9 | 86.4 |
| C-2 | A-1 | Q-2 | 800 | 10 | 13.8 | 17.9 | 46.3 | 87.5 |
| C-3 | A-1 | Q-3 | 900 | 1 | 13.7 | 17.3 | 45.8 | 87.0 |
| C-4 | A-1 | Q-4 | 900 | 1 | 14.0 | 17.6 | 47.8 | 82.6 |
| C-5 | A-1 | Q-5 | 800 | 10 | 13.7 | 15.0 | 45.2 | 91.5 |
| C-6 | B-1 | Q-2 | 800 | 10 | 13.0 | 23.5 | 41.6 | 92.4 |
| C-7 | A-4 | P-1 | 800 | 10 | 14.1 | 12.4 | 48.1 | 76.4 |
| C-8 | A-4 | P-3 | 800 | 10 | 14.0 | 12.8 | 47.1 | 77.9 |
| C-9 | A-4 | P-4 | 800 | 10 | 14.0 | 13.6 | 47.2 | 71.7 |
| C-10 | A-4 | P-5 | 800 | 10 | 14.1 | 13.8 | 46.1 | 69.7 |
| C-11 | A-4 | P-7 | 800 | 10 | 14.0 | 13.7 | 47.8 | 75.6 |
| C-12 | A-4 | P-8 | 900 | 1 | 13.9 | 14.2 | 47.3 | 70.8 |
| C-13 | A-4 | P-9 | 900 | 1 | 13.9 | 14.2 | 48.0 | 78.3 |
| C-14 | A-4 | P-10 | 900 | 1 | 14.0 | 14.8 | 48.0 | 76.6 |
| C-15 | A-4 | P-11 | 900 | 1 | 14.0 | 15.3 | 47.5 | 70.3 |
| C-16 | A-4 | P-12 | 900 | 1 | 14.0 | 13.9 | 47.8 | 75.9 |
| C-17 | A-4 | P-13 | 900 | 1 | 14.0 | 15.9 | 47.7 | 73.2 |
| C-18 | A-4 | P-4m | 800 | 10 | 13.9 | 14.5 | 46.7 | 70.6 |

TABLE 7

MAGNETIC PROPERTIES OF THE BASE MATERIAL COMPACTS

| BASE MATERIAL NUMBER | MAGNETIC PROPERTIES Br (kG) | $H_{cJ}$ (kOe) | $(BH)_{max}$ (MGOe) | SQ (%) |
|---|---|---|---|---|
| A-1 | 13.9 | 15.2 | 47.2 | 93.6 |
| A-2 | 13.8 | 14.1 | 46.7 | 94.2 |
| A-3 | 14.0 | 12.9 | 47.5 | 88.8 |
| A-4 | 14.2 | 11.3 | 48.1 | 84.3 |
| B-1 | 13.0 | 20.6 | 41.6 | 94.0 |
| B-2 | 14.0 | 14.8 | 48.2 | 91.8 |

Tables 5 through 7 teach the following:

(1) The samples S-1 through S-17 and S-24 through S-28 which used the base material compacts A-1 or B-1 showed extremely high magnetic property and high squareness quality (SQ) of a magnetization curve. These samples had characteristics in that they had low oxygen content (0.14 and 0.15 weight percent) of the base material, and the powder applied to the surface of the base material compact for the grain boundary diffusion process contained Al in a metallic state.

(2) Comparing the cases where the same base material compact A-1 was used, the samples S-1, S-4, S-7, and S-8 of the present embodiment in which the powder to which a 10 weight percent Al in a metallic state was applied was used have the increased $H_{cJ}$ than the samples C-1, C-2, C-3, and C-4 of the comparative examples in which Al was not contained and other compositions were the same as the present embodiment were used by 0.9 kOe, 2.5 kOe, 2.2 kOe, and 2.4 kOe, respectively.

(3) Also in the cases where the base material compacts A-2, A-3, and B-2 were used whose oxygen content of the base material was higher than that of A-1 and B-1, $H_{cJ}$ was increased by performing a grain boundary diffusion process using a powder containing Al. However, compared to the cases where A-1 and B-1 was used as a base material compact, the increase in $H_{cJ}$ was slightly smaller and the squareness quality of the magnetization curve was slightly decreased.

(4) The samples C-7 through C-18 of comparative examples using the base material compact (A-4) whose oxygen content was more than 0.4 weight percent had a smaller increase in $H_{cJ}$ than the cases of the present embodiment, and the deterioration of the magnetic properties other than $H_{cJ}$ was large. In particular, the deterioration of the squareness quality SQ of the magnetization curve below 80% is a problem. With such a low squareness quality of the magnetization curve, the temperature property would be poor even if $H_{cJ}$ significantly increases. Therefore, applications to high-performance motors and other application products in which the products manufactured according to the present invention are used cannot be expected. Consequently, it is concluded that the samples C-7 through C-18 of the comparative example have poor applicability to practical uses.

(5) The samples S-2 through S-6 using the powder containing Al of 1, 3, 10, 30 and 50 weight percent (and also $DyF_3$) can achieve an effect of the grain boundary diffusion process in the present invention. On the other hand, in the sample C-5 of the comparative example using the powder Q-5 containing a 70 weight percent of Al and a 30 weight percent of $DyF_3$, the entire surface layer containing Dy fell off the surface after the grain boundary diffusion process and the magnetic properties of the magnet were thus low. In these samples, it is thought that the surface layer is stripped due to the formation of a friable layer on the surface or other processes during the heating for the grain boundary diffusion process, and therefore diffusion of Dy does not effectively occur.

(6) The samples S-4 and S-17 had the common sintered base material compact (A-1) and the composition ($DyF_3$: 90%, Al: 10%) of the powder, but only the powder's state was different. That is, the sample S-4 and sample S-17 were different only in the respect that although the powder P-4 used for the sample S-4 was a mixed powder of $DyF_3$ powder and Al powder, the powder P-4m used for the sample S-17 was a powder of the alloy prepared from this mixed powder as previously described. The magnetic properties of the sample S-4 were slightly better than those of the sample S-17. In general, when many samples are manufactured under the same condition, the properties of the samples vary: however, even in repeatedly performing the same experiments, the effect of the increase in $H_{cJ}$ as previously described was reproducibly achieved, and the variance was small. Also in the case where the similar experiment was performed for the base material compacts A-2, A-3, and B-1 as substitute for the base material compact A-1, the effect of the increase in $H_{cJ}$ was slightly larger and the variance was smaller in the case of use of the powder P-4m than the case of use of the powder P-4. This tendency was also confirmed by comparing the case where the powder P-8 was used in which 10% of Al was mixed to the powder M-1 which was obtained by crushing an alloy containing only 0.2% of Al and the case where the powder P-9 was used which was obtained by crushing an alloy having a composition similar to that of P-8. That is, $H_{cJ}$ was slightly larger and the variance in the properties was smaller with many manufactured samples in the case of usage of the powder P-9 than the case of usage of the powder P-8. Thus, using a powder obtained by previously melting or alloying Al with a substance containing Dy and then crushing it can be an industrially excellent method rather than using a mixture of a powder containing Al and powder containing Dy. The reason of this can be thought that the coating quantity of each component and the order of coating vary in the case where a mixed powder is used, and in the meantime such a variance does not occur with a powder after a melting and alloying process.

The invention claimed is:

1. A method for making a NdFeB sintered magnet including processes of coating a NdFeB sintered magnet base material compact with a powder containing $R^h$, where $R^h$ represents Dy and/or Tb, then heating the NdFeB sintered magnet base material compact, and thereby diffusing $R^h$ in the powder into the NdFeB sintered magnet through a grain boundary, and obtaining a NdFeB sintered magnet that has a coercive force $H_{c1}$, value within a range of from 19.0 to 26.9 kOe, wherein:

the powder contains 0.5 through 50 weight percent of Al in a metallic state;

at least a part of the Al is diffused by the heating through the grain boundary; and an amount of oxygen contained in the NdFeB sintered magnet base material compact is equal to or less than 0.4 weight percent.

2. The method for making a NdFeB sintered magnet according to claim 1, wherein the amount of oxygen is equal to or less than 0.3 weight percent.

3. The method for making a NdFeB sintered magnet according to claim 1, wherein the powder contains a fluoride of $R^h$.

4. The method for making a NdFeB sintered magnet according to claim 1, wherein the powder contains a powder of an alloy of $RR^hT$, where R represents one or plural kinds from among rare earth elements other than Dy and Tb, and T represents one or plural kinds from among Fe, Co, and Ni, and/or an alloy of $RR^hTB$.

5. The method for making a NdFeB sintered magnet according to claim 2, wherein the powder contains a fluoride of $R^h$.

6. The method for making a NdFeB sintered magnet according to claim 2, wherein the powder contains a powder of an alloy of $RR^hT$, where R represents one or plural kinds from among rare earth elements other than Dy and Tb, and T represents one or plural kinds from among Fe, Co, and Ni, and/or an alloy of $RR^hTB$.

7. The method for making a NdFeB sintered magnet according to claim 3, wherein the powder contains a powder of an alloy of $RR^hT$, where R represents one or plural kinds from among rare earth elements other than Dy and Tb, and T represents one or plural kinds from among Fe, Co, and Ni, and/or an alloy of $RR^hTB$.

8. The method for making a NdFeB sintered magnet according to claim 5, wherein the powder contains a powder of an alloy of $RR^hT$, where R represents one or plural kinds from among rare earth elements other than Dy and Tb, and T represents one or plural kinds from among Fe, Co, and Ni, and/or an alloy of $RR^hTB$.

9. The method for making a NdFeB sintered magnet according to claim 1, wherein the SQ value of the NdFeB sintered magnet is higher than 80 percent.

* * * * *